US007444764B2

(12) United States Patent
Mark

(10) Patent No.: US 7,444,764 B2
(45) Date of Patent: Nov. 4, 2008

(54) METHOD OF AND STRUCTURE FOR SHEDDING, OR PROTECTING SHOE UPPERS FROM SOLE-EJECTED WATER SPRAY AND THE LIKE

(76) Inventor: Gregory Mark, 14 Remington St., Apt. 303, Cambridge, MA (US) 02138

( * ) Notice: Subject to any disclaimer, the term of this patent is extended or adjusted under 35 U.S.C. 154(b) by 361 days.

(21) Appl. No.: 11/146,345

(22) Filed: Jun. 6, 2005

(65) Prior Publication Data

US 2006/0277790 A1 Dec. 14, 2006

(51) Int. Cl.
*A43B 13/00* (2006.01)

(52) U.S. Cl. ..... 36/25 R; 36/8.1; D2/908; D2/960

(58) Field of Classification Search ..... 36/25 R, 36/114, 102, 8.1; D2/908, 947, 951, 960
See application file for complete search history.

(56) References Cited

U.S. PATENT DOCUMENTS

| | | | | | |
|---|---|---|---|---|---|
| 1,820,043 | A | * | 8/1931 | Benz | 36/70 R |
| D190,162 | S | * | 4/1961 | Hubbard | D2/960 |
| 3,006,085 | A | * | 10/1961 | Bingham, Jr. | 36/59 C |
| 4,262,433 | A | * | 4/1981 | Hagg et al. | 36/25 R |
| 4,393,605 | A | * | 7/1983 | Spreng | 36/114 |
| 5,918,385 | A | * | 7/1999 | Sessa | 36/59 C |
| 6,321,469 | B1 | * | 11/2001 | Cretinon | 36/102 |
| D490,225 | S | * | 5/2004 | McClaskie | D2/960 |
| 7,204,044 | B2 | * | 4/2007 | Hoffer et al. | 36/116 |

* cited by examiner

*Primary Examiner*—Marie Patterson
(74) *Attorney, Agent, or Firm*—Rines and Rines

(57) ABSTRACT

A novel technique for preventing ground-water wetting and spraying of footwear uppers during walking or running, through use of special downwardly opened cavities or recesses provided in the sole.

21 Claims, 16 Drawing Sheets

(D)

METHOD OF AND STRUCTURE FOR SHEDDING, OR PROTECTING SHOE UPPERS FROM SOLE-EJECTED WATER SPRAY AND THE LIKE

FIELD

The present invention relates generally to footwear; being more particularly concerned with the shielding or protecting from deleterious water spray or other water transfer effects from wet environments as the wearer walks or runs upon wet surfaces and the like.

BACKGROUND OF INVENTION

The waterproofing of footwear has received copious attention through the centuries, and many techniques have been proposed and used, tailored to the wide variety of footwear designs. Water-impermeable soles are common, as of rubber or plastic; and protective barriers of a variety of different types have been used for the shoe uppers—all directed to preventing the transfer of water from outside onto the uppers and/or into the inner part of the shoe that receives the foot. Uppers made of rubber or the like, as in work shoes or boots, moreover, do not allow the escape of the wearer's perspiration developed in the interior of the footwear and lead to undesired effects such as chafing, blister formation, growth of fungi and, at the very least, unpleasant odors.

Membranes have been developed such as "Gore-Tex", described, for example, in German Patent 296D1932 (WO97/28711) and a similar membrane as described, for example, in U.S. Pat. No. 6,839,984, which provide the dual functionality of creating an effective water barrier while allowing some mitigation of internally developed water vapor, providing for the lowering of the internal production of perspiration, which, however, will still, none-the-less, accumulate within the footwear. Airflow through the upper has also been proposed as, for example described in English Patent 2,279,984, which will tend to decrease the partial pressure of the water vapor developed inside the shoe and thereby somewhat reduce liquid condensation in the footwear. Structures for achieving such airflow, and with it cooling, are loosely woven fabrics or mesh or apertures provided in the upper materials. Using such ventilated footwear in wet environments, however, allows water to enter and accumulate—often at a faster rate than water evaporation.

Other patent proposals for trying to solve such problems of inside and outside wetting effects are also described, for example, in German Patent 10328699.3 (WO2005/000061) and in U.S. Pat. Nos. 5,689,903 and 4,899,465 among others.

Similar splash-wetting action also occurs at the heel of the footwear as the wearer lifts it from the groundwater, splashing rearwardly upwardly to soil the heel region of the upper and the cuff regions of trousers or other long apparel extending thereto.

Up until the present invention, however, it is not believed that a universal structure for effectively shedding sole-adhered water spray has been achieved.

OBJECTS OF INVENTION

The primary object of the invention is to address and solve these wetting problems in a novel practical inexpensive and universal manner—the invention providing both a new and improved method of automatically protecting footwear from sole-ejected water spray and the like, and also novel attachable or integral structures upon the footwear itself and more particularly the sole regions thereof, significantly improving upon prior art attempts adequately to provide solutions with their above-described and other attendant disadvantages or limitations.

Other and further objects will be explained hereinafter and are pointed out in the appended claims.

SUMMARY OF INVENTION

In summary, from the viewpoint of suppressing forward and upward water spray from flat-soled footwear picked up in ground water, the inventions involves a method of obviating the wetting effects on footwear uppers by spray from ground-plane water layers that attach to the footwear sole during the walking stride of a wearer, and are first accelerated therewith and then detached therefrom as the wearer reduces forward velocity near the end of the stride, thereby separating and ejecting the water layer upwardly of the sole and generating said spray, the method comprising, flowing the detached water layer forwardly along the sole and into an entrance to a partially substantially cylindrical downwardly open cavity provided in the sole and extending transversely across the sole near the toe region thereof; dimensioning the volume of the cylindrical cavity, smoothly and arcuately to reverse the forward flow of the water entering the cavity; and providing a steep cavity exit wall having a sharp transversely extending trailing edge that ejects the reversely flowing water layer rearwardly out of the cavity as the wearer approaches near said end of the stride, whereby the spray wetting of the upper is prevented.

As for upward spray produced at the heel region, the invention further provides a method of obviating the wetting effects on footwear upper heel regions by spray from ground-plane water layers that attach to the footwear sole during the walking stride of a wearer and wherein a rearward portion of the attached layer lags the forward acceleration of the sole during the stride, resulting in said rearward layer portion rearwardly separating from the forwardly moving sole and thereby generating rearward and upward spray, the method comprising, flowing said ground-plane water layer portion as it lags rearwardly along and relative to the sole into the entrance of a partially substantially cylindrical downwardly open cavity provided and extending transversely substantially completely across the sole in a region near the heel region; dimensioning the volume of the cavity, smoothly and arcuately to reverse the rearward flow of the water layer entering the cavity; and providing a steep cavity exit wall having a sharp transversely extending trailing edge that ejects the reversely flowing water layer out of the cavity as the wearer continues the stride, whereby said spray wetting of the upper heel region is prevented.

Articles or structures preferred for achieving results reside in a footwear sole incorporating a downwardly open partially substantially cylindrical re-entrant cavity structure for diverting ground water spray, the cavity structure extending linearly substantially completely across the sole near one or both of the nose and heel regions of the sole; the cavity structure being bounded by an entrance wall for flowing the water into and along an interior wall, and by a steep exit wall; the cavity structure volume and the shape of the interior wall and of the exit wall being such as to reverse the direction of the entering water flow and to eject the water from the interior of the cavity structure in such reverse direction.

Preferred and best mode designs and structures and operation are hereinafter described in detail.

DRAWING

The invention will now be described in connection with the accompanying drawings, FIG. 1A of which is a side elevational diagram illustrating the successive stages A,B,C,D and E of the sole picking up groundwater layers as the footwear wearer strides in walking, and the forward and rearward ejection of upper-wetting at the respective nose and heel regions, as in current and prior walking;

Figure 5:
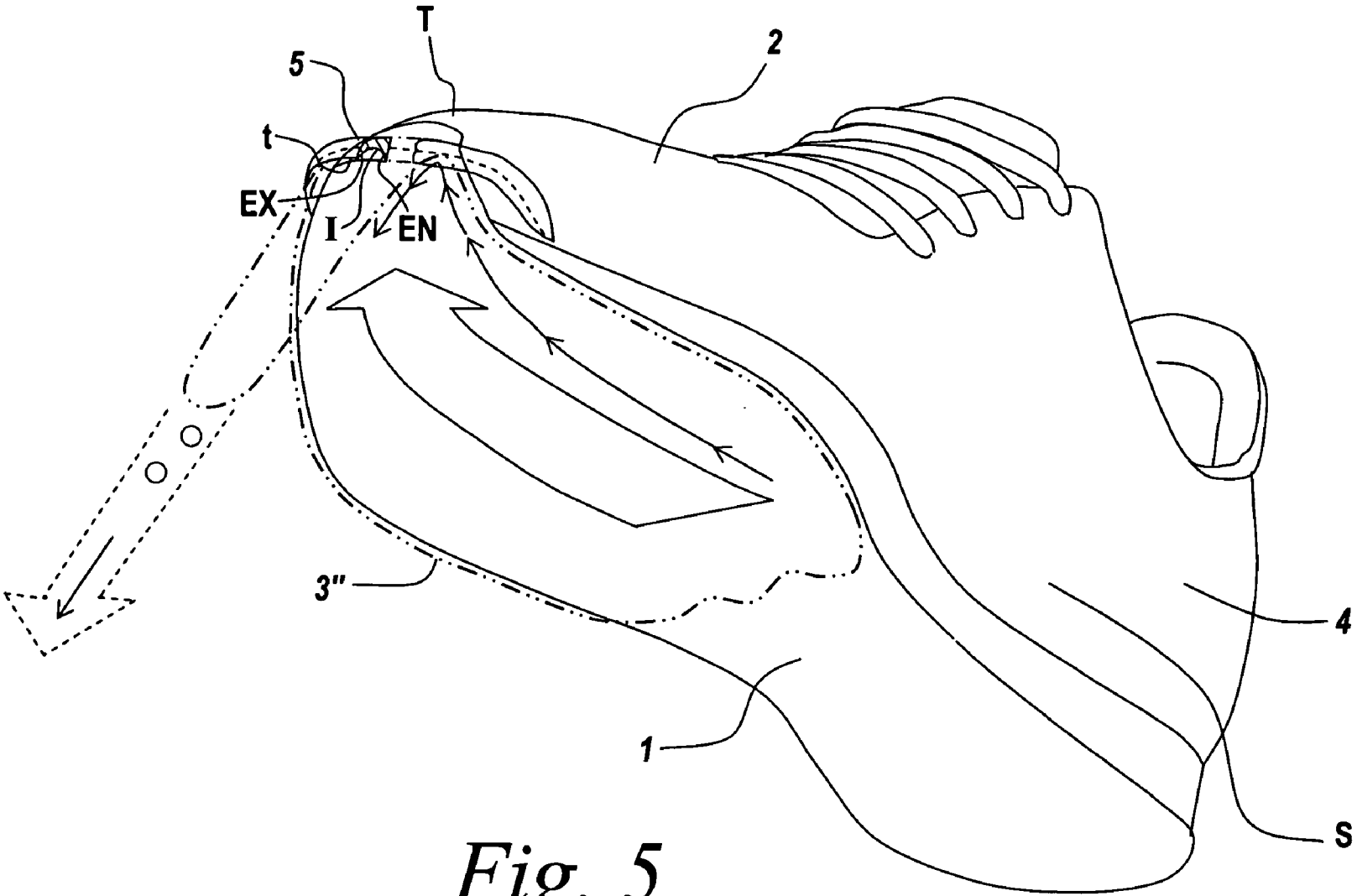
FIG. 5 is an isometric view similar to FIG. 2, also illustrated for a sole forwardly and upwardly curvedly urged into the nose region of the upper, in which a novel round-water spray cylindrical cavity deflector of the invention has been applied to the toe region of the footwear to deflect the spray-producing water forwardly and downwardly and away from the upper.
Figures 8, 8A, 8B, 8C, 8D:
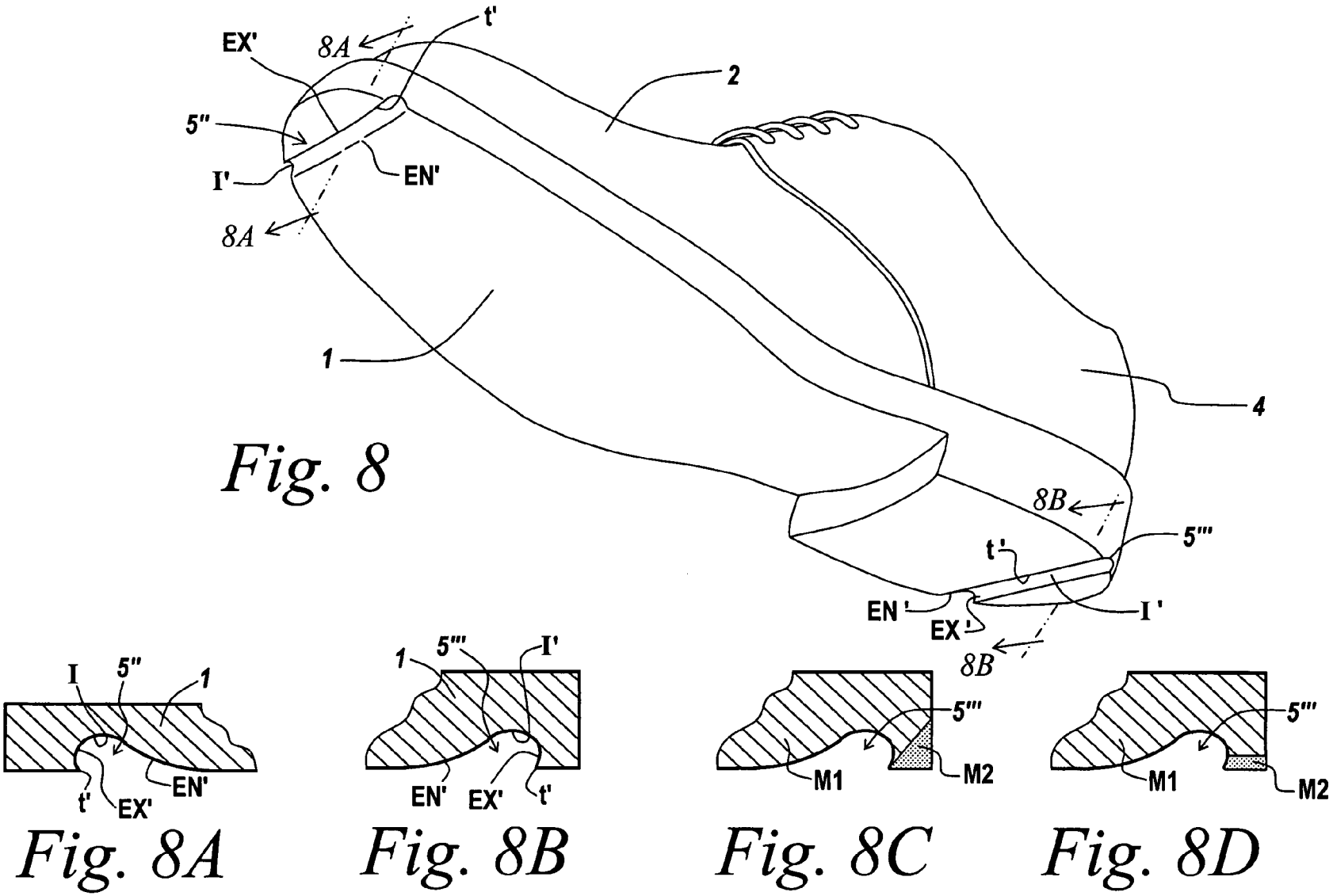
Figure 9:
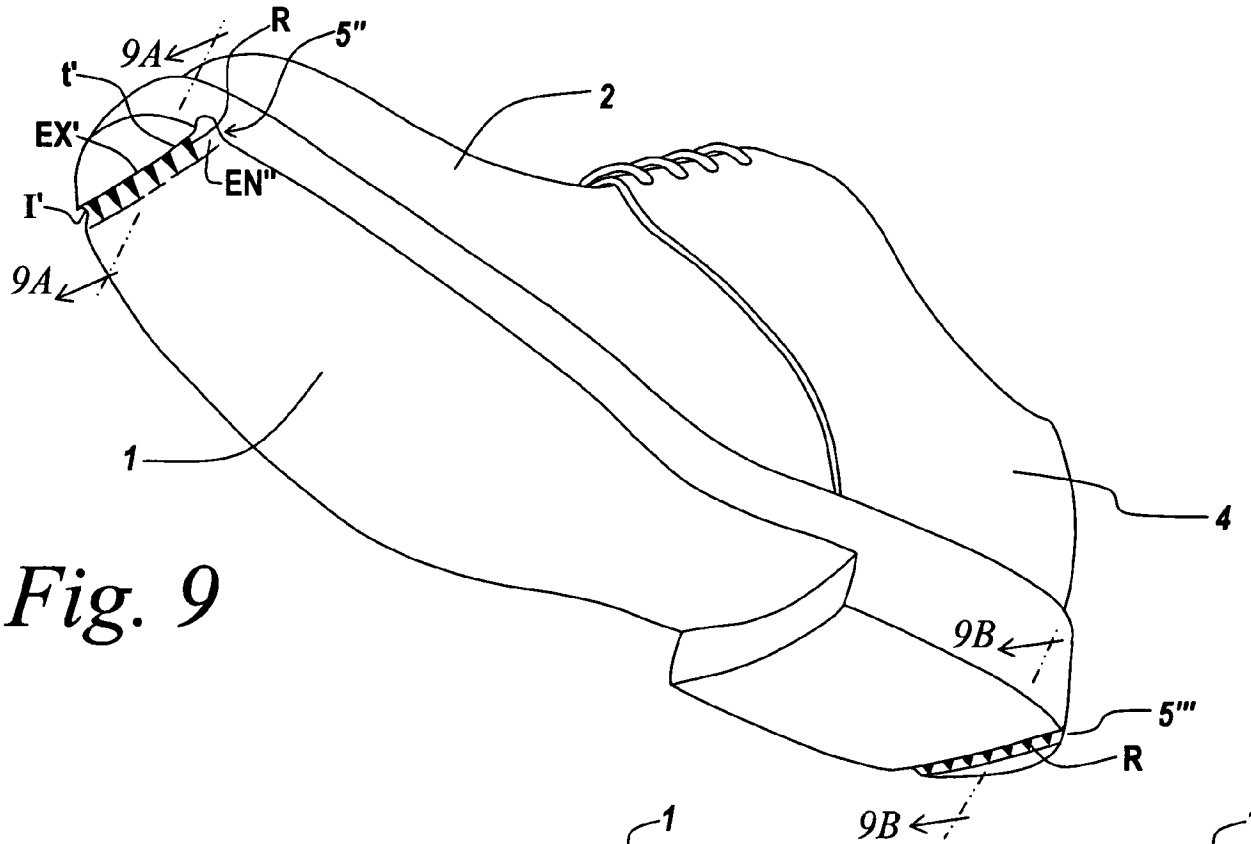
Figure 9C:
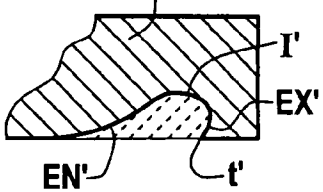
Figure 9B:
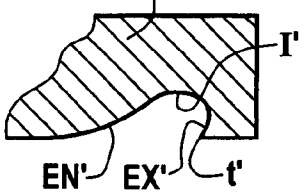
Figure 9A:
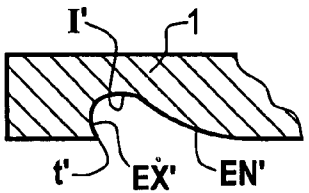
Figure 10:
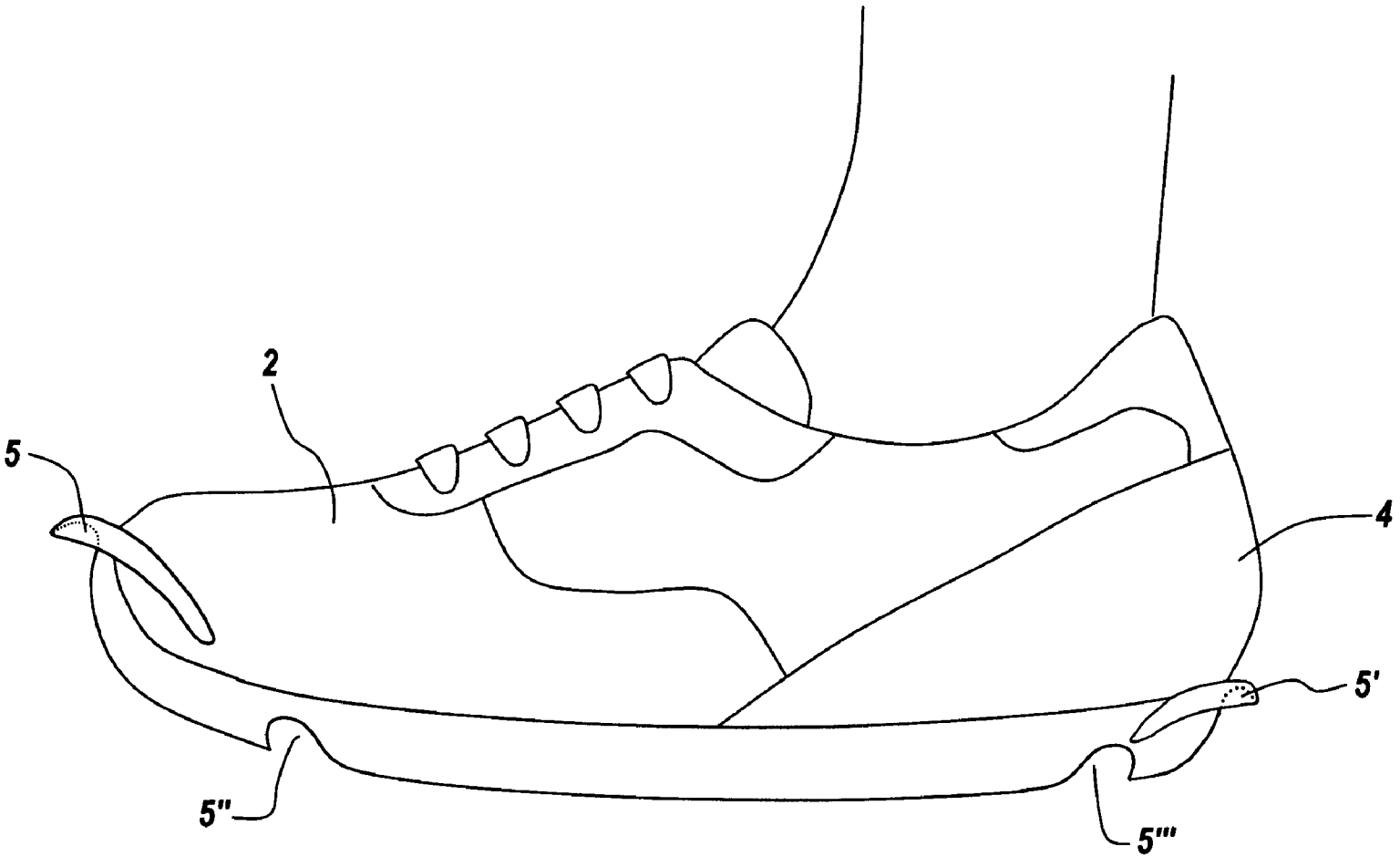
Figure 11:
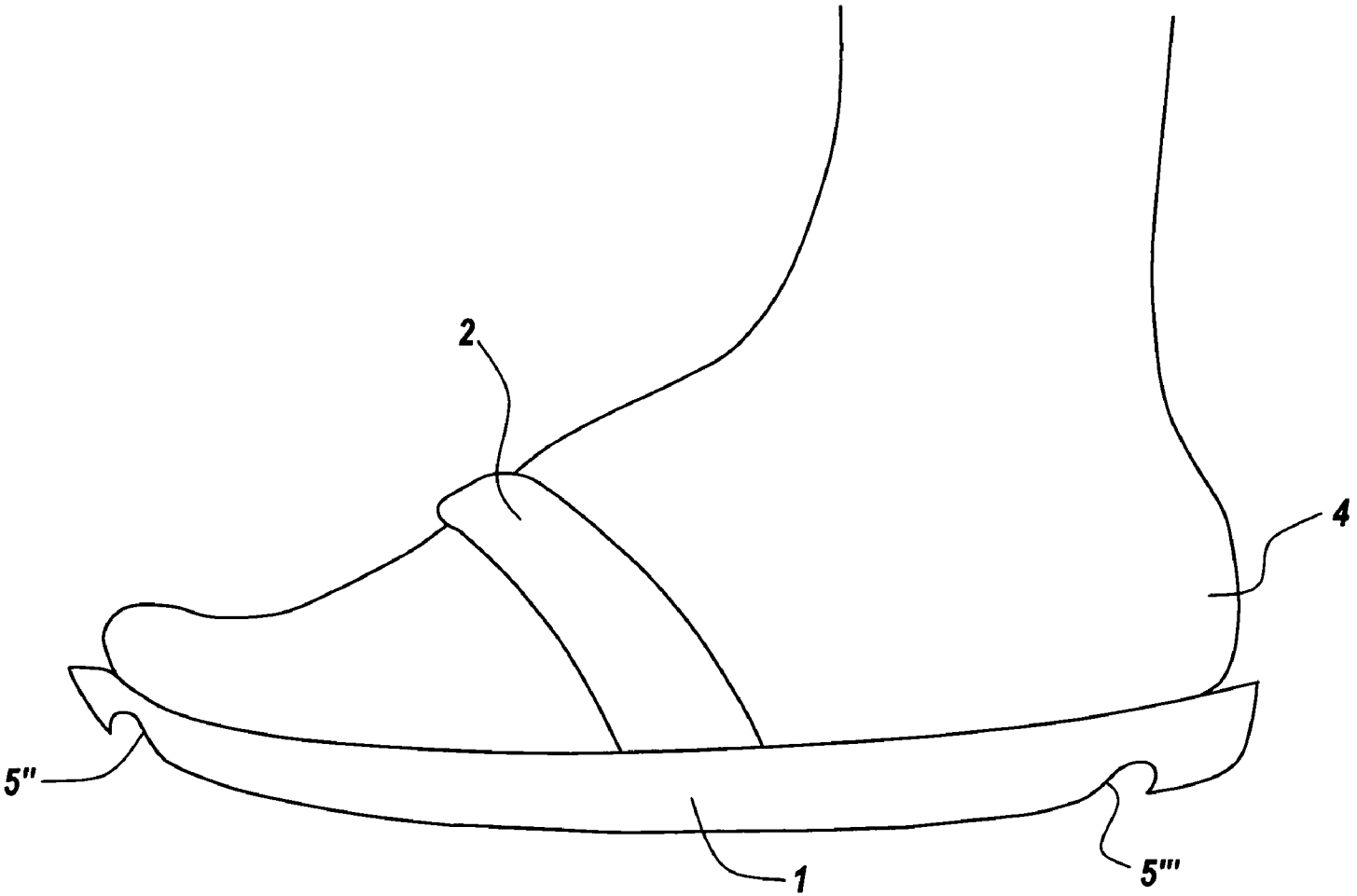
Figure 12A:
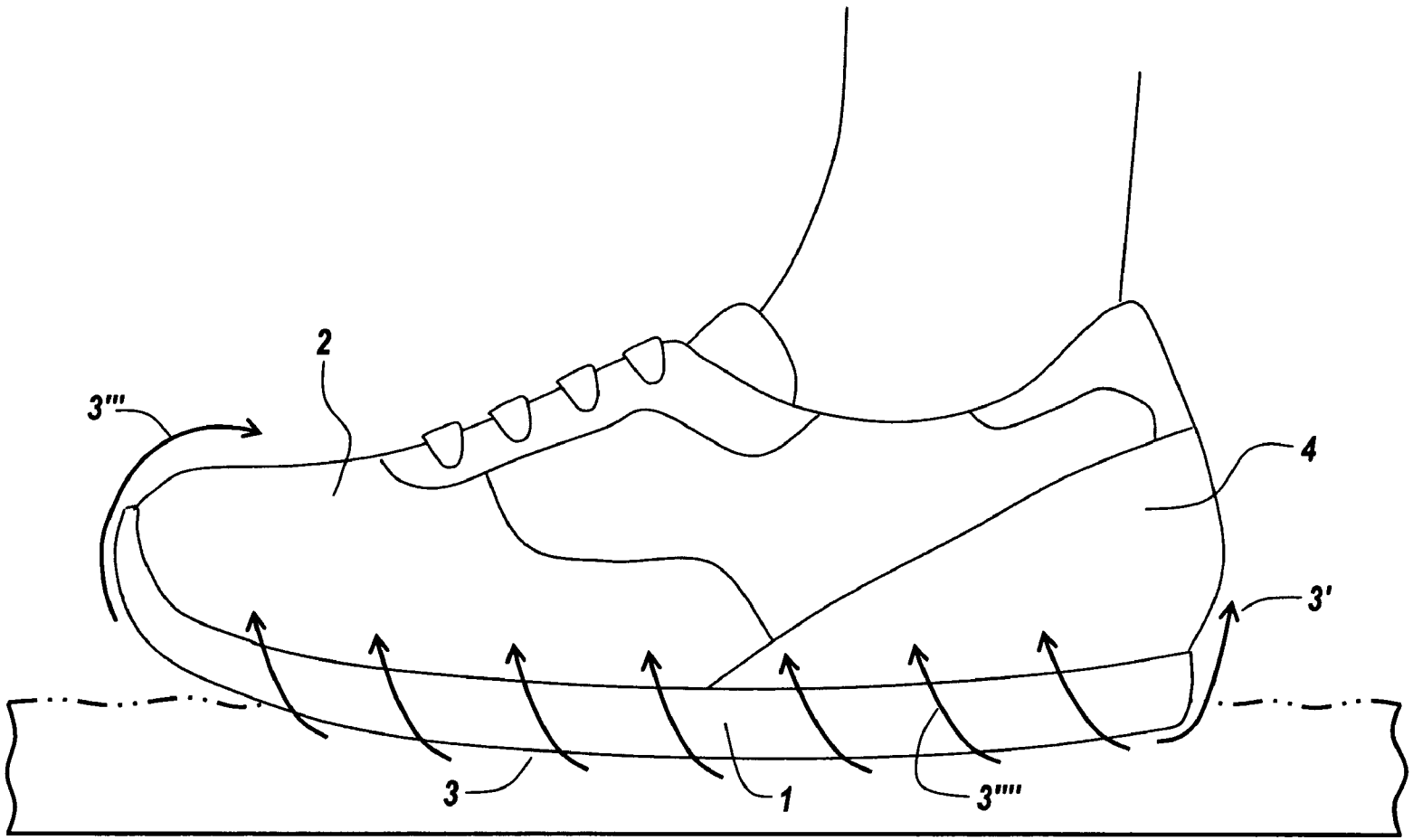
Fig. 12A (Prior Art)
Figure 12A:
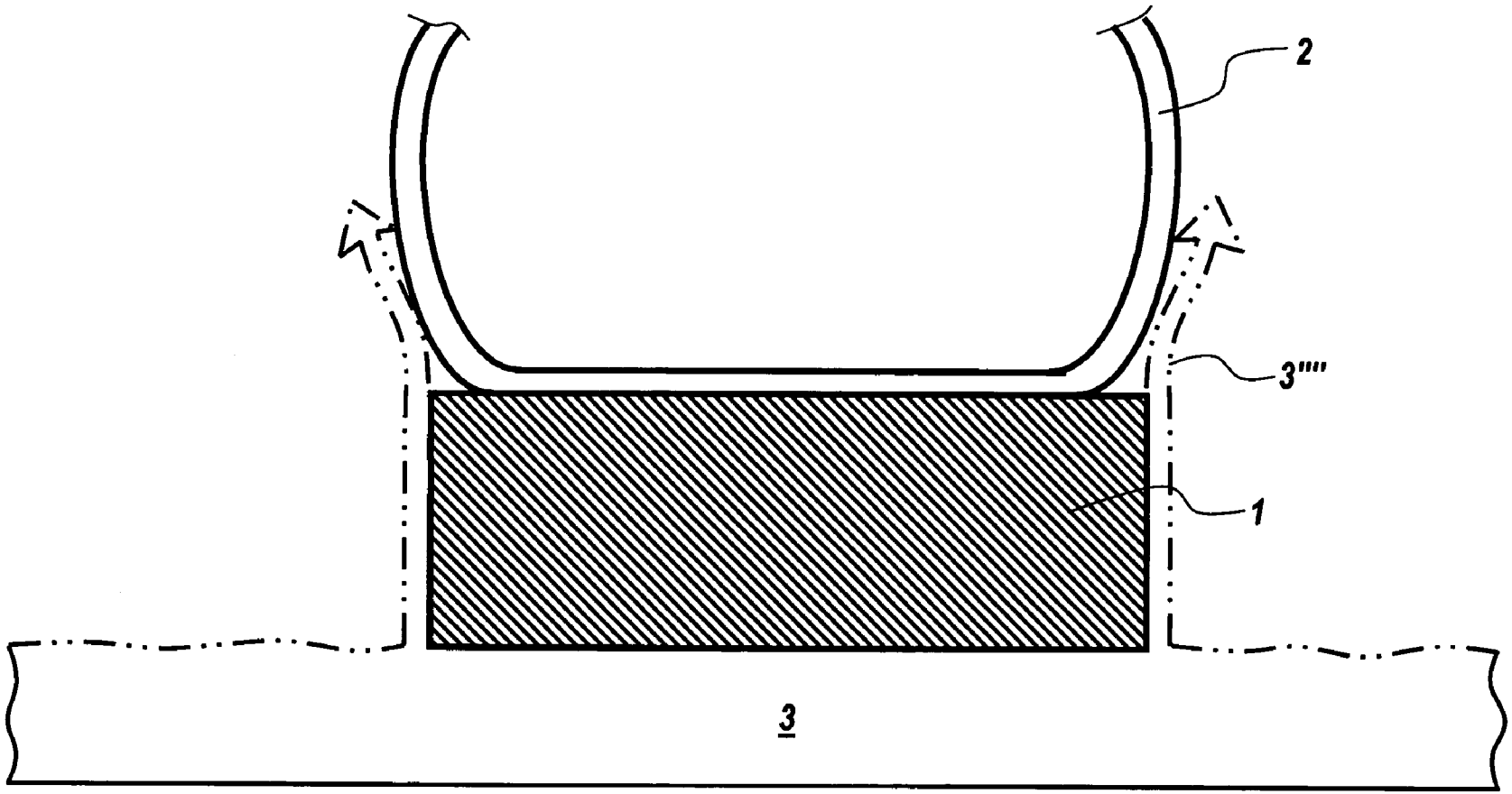
Fig. 12A' (Prior Art)
Figure 12B:
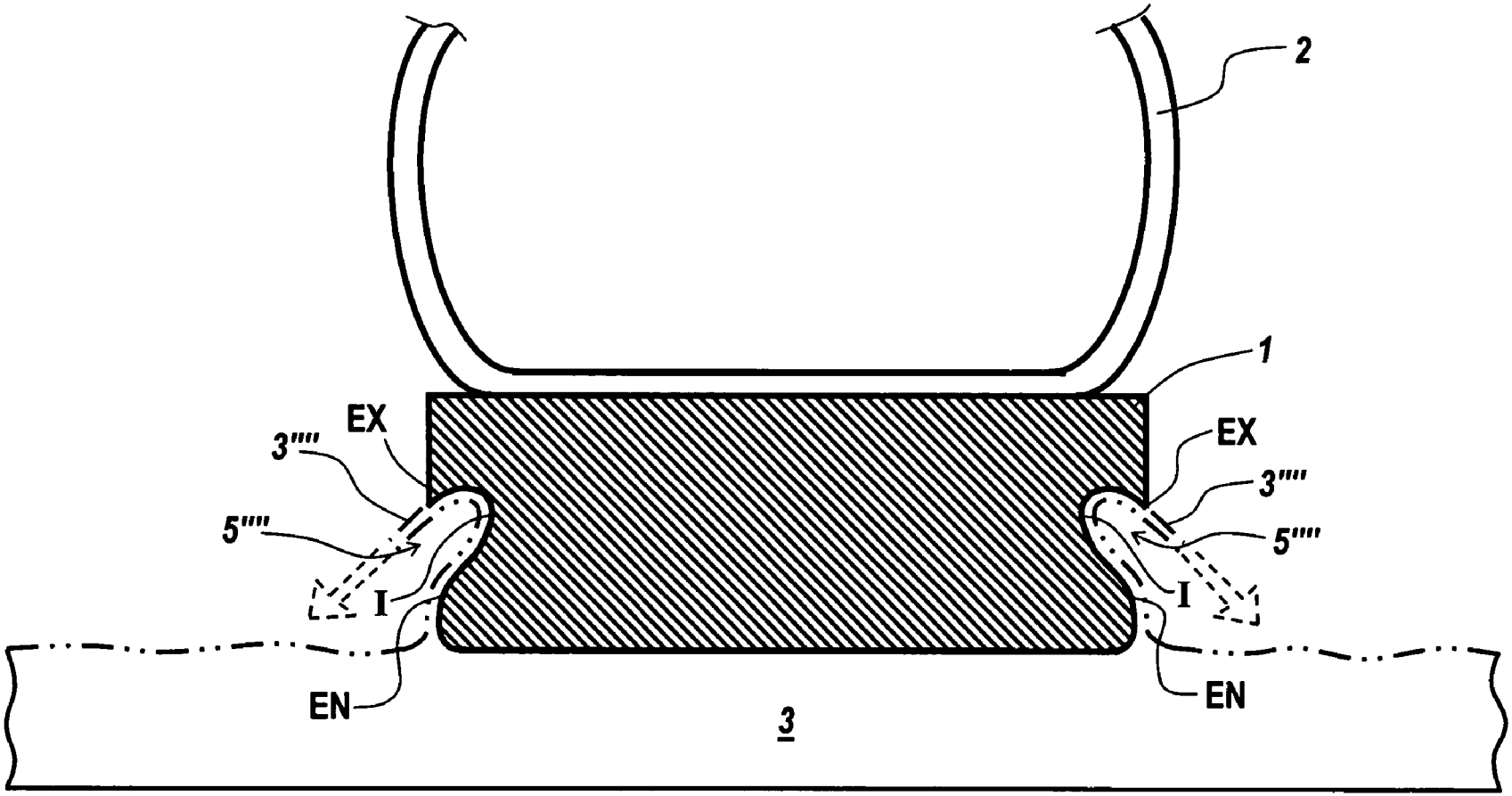
Figure 12C:
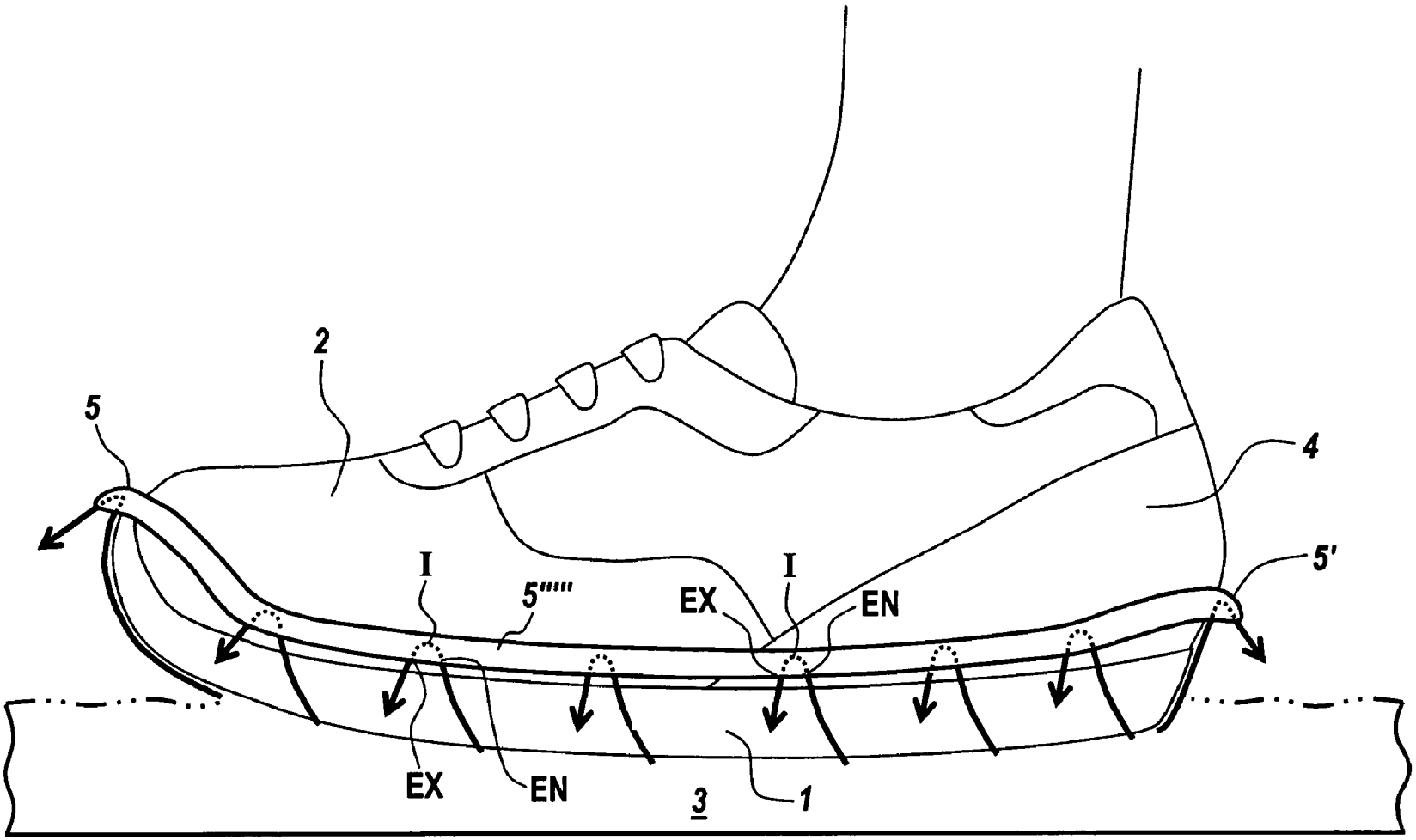

FIG. 8 is an isometric view similar to FIG. 5, but this time for a dressier type shoe and flat sole (showing the universal application of the invention) and wherein, in preferred form, the spray deflection cylindrical cavity structure is made in the form of a re-entrant cavity strip integral within the sole—shown both in the nose region and in the heel region, though either above may be used, as desired;

FIGS. 8A and 8B are cross-sectional views taken along the respective lines 8A-8A and 8B-8B of FIG. 8 and of larger scale, and FIGS. 8C and 8D illustrated modified different wetting materials incorporated therein;

FIG. 9 is a view similar to FIG. 8 but modified to include transversely spaced reinforcing ribs lined along the interior of the cavity structure;

FIG. 9 is a view similar to FIG. 8 but modified to include transversely spaced reinforcing ribs lined along the interior of the cavity structure;

FIGS. 9A and 9B or enlarged views of respective transverse sections taken along section lines 9A-9A and 9B-9B between cavity ribs and FIG. 9, and FIG. 9C at a ribbed region;

FIG. 10 is a side-elevation of a further modification illustrating the use of both nose and heel region cylindrical cavity deflector attachments;

FIG. 11 is a side elevation of still another application of the invention to open-toed sandal footwear, using the re-entrant cavities in the nose and heel regions of the sole;

FIG. 12A and 12A' are side elevation and a transverse section upon an enlarged scale showing side wetting, particularly from deeper groundwater; and FIG. 12B is a view of still a further modification wherein side downward the open cavity strips are also provided in the sole sides to deflect the side water of FIG. 12A; and FIG. 12C shows the side cavity strips mounted just above the sole.

DETAILED DESCRIPTION OF PREFERRED EMBODIMENTS OF THE INVENTION

Prior to describing the preferred embodiments of the drawings, it is believed helpful first to expand further upon the discovered cause of the problem underlying much of footwear upper wetting with relatively flat-soled footwear.

Introduction

As the wearer of such footwear takes an initial step on the wet ground or other surface, the foot lifts off the contact surface and accelerates forward. A full or partial thin film of water adheres to the sole. As the foot accelerates forwardly relative to the water, some water can not keep up with the acceleration, and is sprayed off in all directions or falls off. The water that remains attached to the sole, however, is accelerated in the direction of the wearer's motion through contact forces with the sole—adhesion, friction, gravity, protrusions, etc., adding momentum to the fluid film. As the wearer and consequently the footwear slows down, the flow continues to move in the forward direction with the sole until some feature, point or discontinuity is reached, as when the wearer has significantly reduced the forward velocity near the end of the walking stride. The forward portion of the flow then separates from the sole and spray is generated upward upon the forward portions of the shoe upper (or foot in the case of sandals or other open-toed footwear).

In many shoes, this feature is the termination at the front end of the sole sometimes part way up the front or toe region of the upper. In the case where the sole curves or wraps up into the upper, as in many types of sportswear, the flow, indeed, can be deposited directly on the upper. In other cases where the sole does not extend into the upper, or at all, the flow projects upward upon the toe of the upper. Due to the general upward curve of the sole, however, through either initial design or through wear, the water flow is launched at a positive arcuate angle, as measured from the generally planar shape of the sole. At the time of launch or separation, the sole of the footwear is typically pointed in a positively upward direction as measured from the walking surface. At the time of fluid detachment, the fluid is thus projected or sprayed in the direction of the summation of both arcuate angles. From that point on, the parabolic trajectory of the fluid spray is governed by gravity and environmental factors. The forward velocity of the footwear, at and after said detachment, indeed, can even place the footwear directly in the natural falling path of the detached water, wetting the upper. The flowing fluid can additionally act as a carrier for dirt, solutes such as salt, and soiling debris, as previously mentioned.

PREFERRED EMBODIMENTS

It is now in order to refer to the drawings for detailed descriptions of preferred implementations of the invention.

Description

Figure 1A:
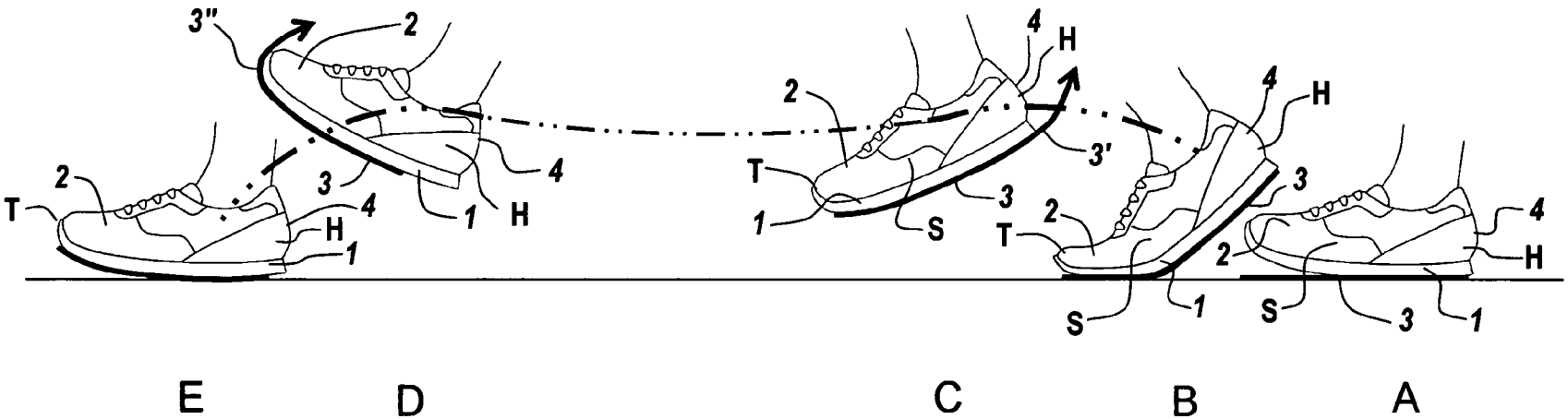
Fig. 1A (Prior Art)
FIG. 1B is a diagram similar to FIG. 1A, but for the footwear wearer running instead of walking, with an extension of the stride to include C' between C and B.

FIG. 1A is a diagram of the successive stages of a footwear wearer walking stride, illustrated with an exemplary sportswear type of shoe S comprising an upper 2 connected to a substantially flat sole 1 (it may be ribbed or patterned but it is still considered as relatively flat herein). In this particular style of molded footwear, the forward end of the sole (as of rubber) curves upward and merges into the forward portion of the front of the upper in the toe region T, and the back end connects to the downwardly curving heel section of the upper at the heel region H.

Underlying the present invention is the discovery of precisely what specific physical phenomenon is primarily responsible for the wetting or spraying of footwear uppers in the toe region 2 and in the heel region 4 during walking, FIG. 1A, (and running, FIG. 1B) on groundwater layers 3, and devising effective structures and techniques for intercepting and deflecting or shedding such spray before it wets or soils the upper regions. Considering the footwear wearer's walking stride of FIG. 1A, once the sole 1 contacts groundwater layers 3 in stage A, the foot lifts through successive stages B, C, D before reaching the ground water again at E.

Figure 4:
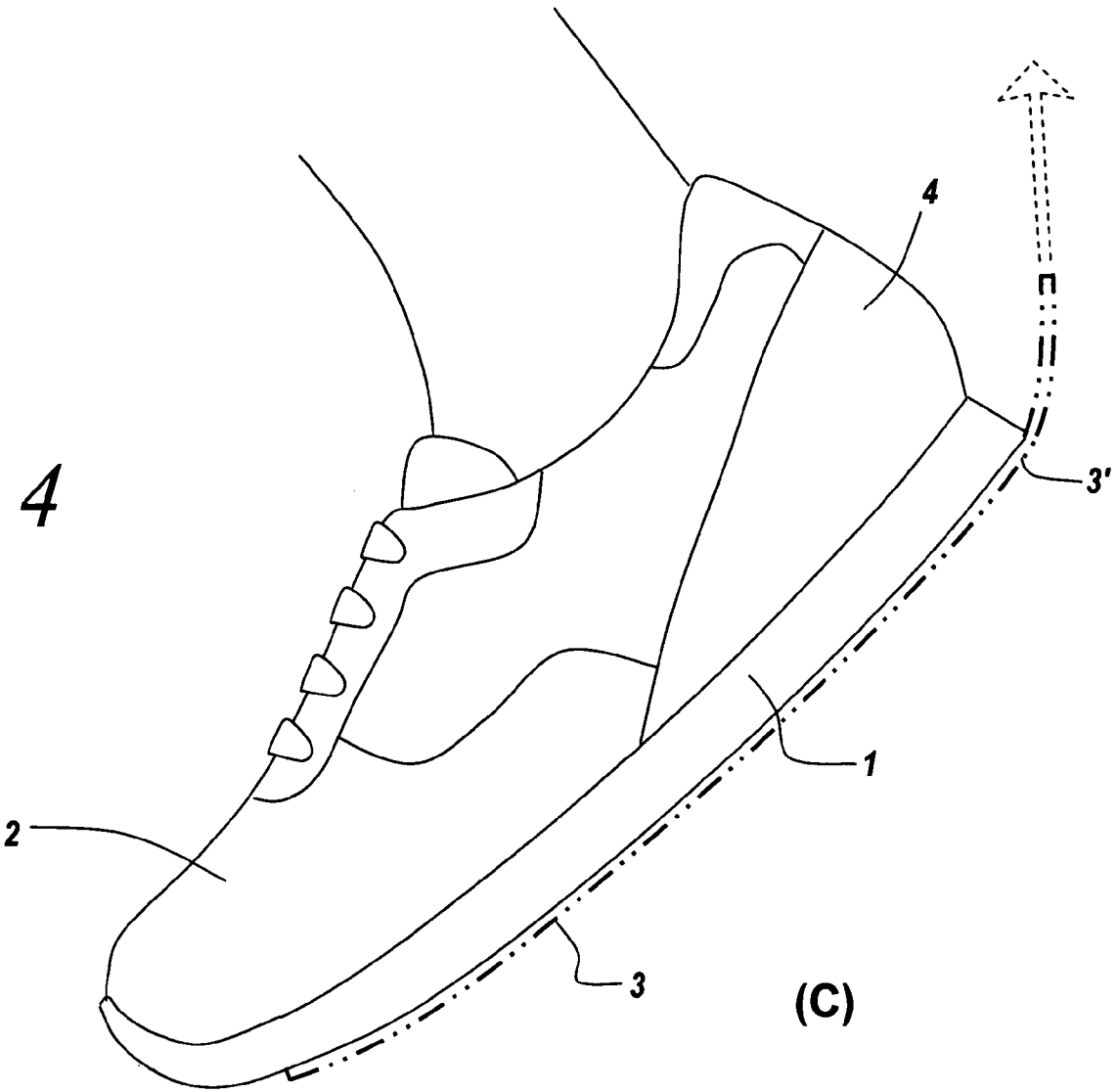
FIG. 4 is a similar enlarged isometric of stage C of FIG. 1 showing the rear water layer portion discovered to lag the forward movement of the footwear and detaching at the arrow to produce the rearward and upward spray on the heel region of the upper.

What has been found is that initially ground-plain water layers 3 attach to the sole 1 (stage A) and start to be accelerated therewith through kick-off and increasing velocities of the stride at stages B and C. In or near stage C, however, it has been discovered that the rearward portion 3' of the attached ground-water layer 3 starts to lag the forward acceleration of the sole 1 during the stride, resulting in such rearward layer portion rearwardly separating from the rear of the forwardly moving sole as at 3' and thereby generating the undesired rearward and upward spray (arrow at 3' stage C) that soils the upper at the heel 4 and pant cuffs or other apparel extending to the heel region, as more clearly shown in FIG. 4.

Figure 1B:
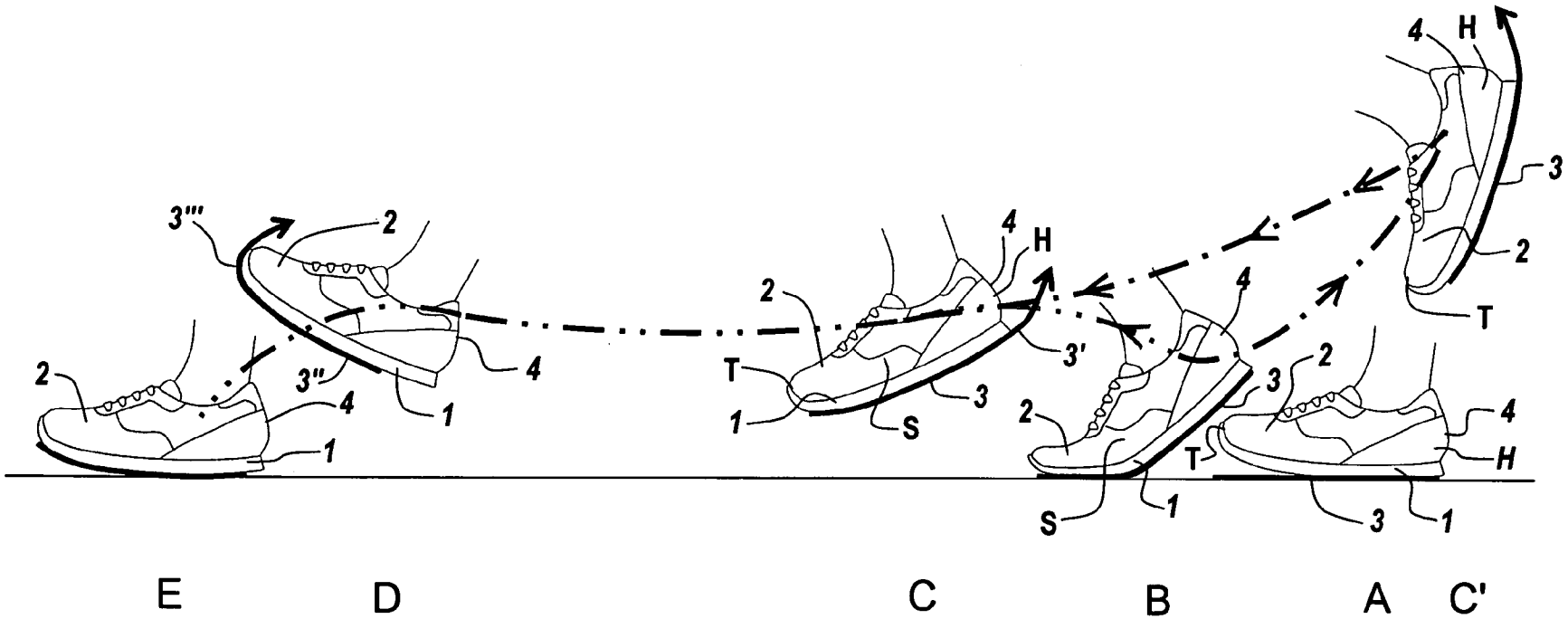
Fig. 1B (Prior Art)
Figure 2:
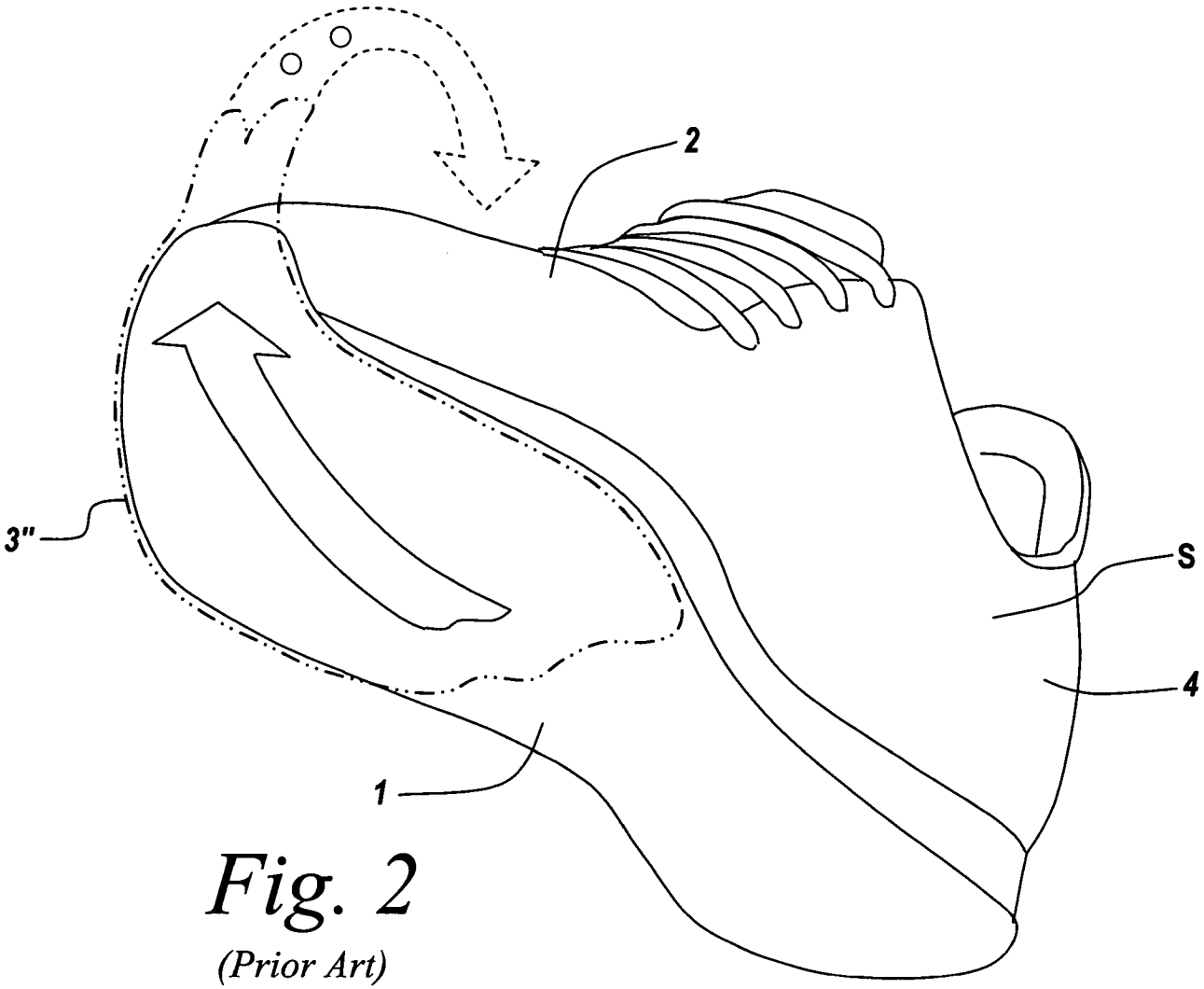
Fig. 2 (Prior Art)
FIG. 2 is an enlarged isometric view of forward groundwater layer portion detachment from the sole and which has been discussed as the cause resultant toe region water spray onto the upper, as represented by the arrow of stage D of FIG. 1, and illustrated for a flat sole of the sport type that is forwardly upwardly and curvedly merged into the upper nose region.
Figure 3:
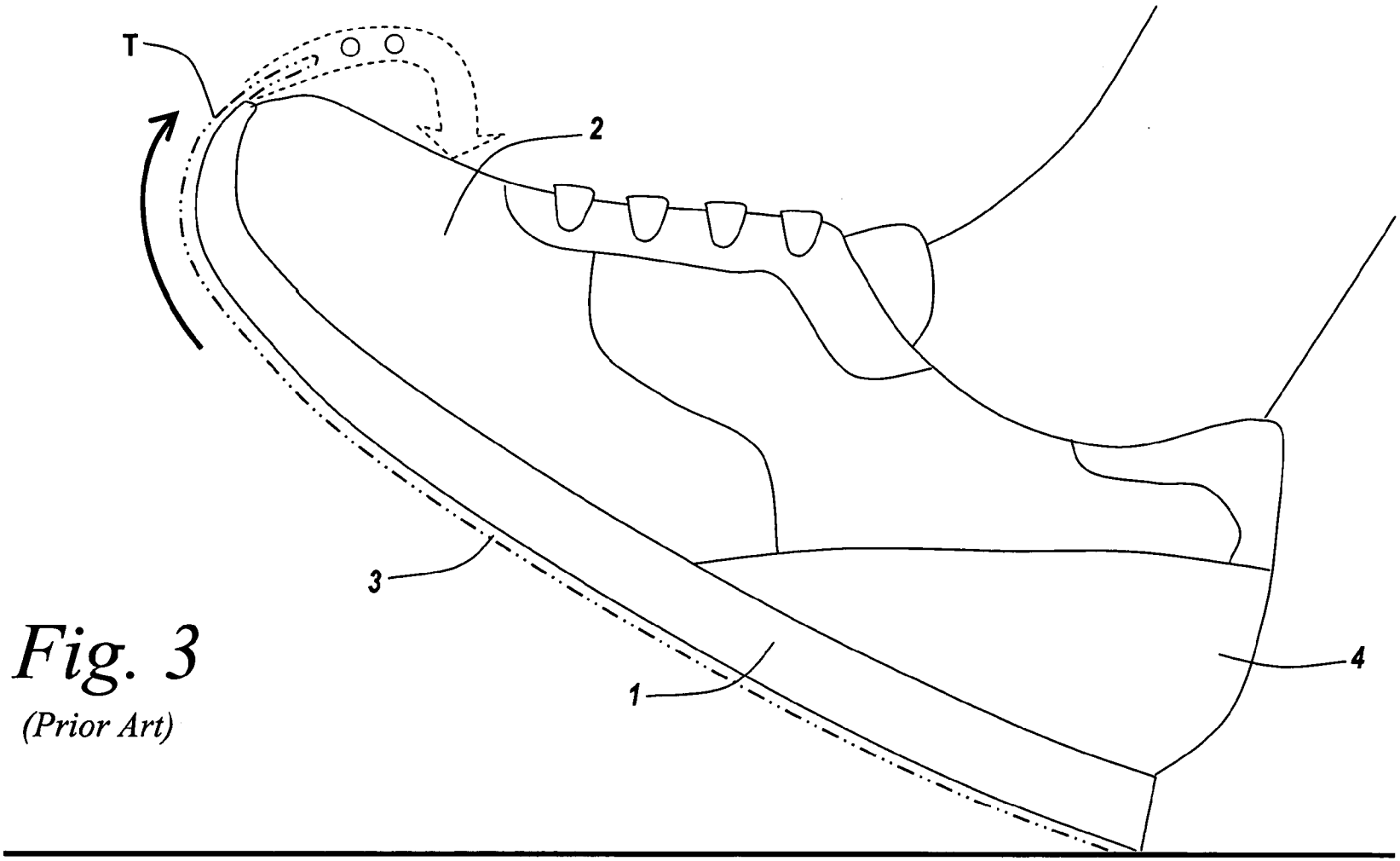
Fig. 3 (Prior Art)
FIG. 3 is a side elevational view of FIG. 2.

As the stride continues, the before-mentioned region or transition point of sufficiently reduced stride velocity is reached as the foot is slowing and lowering near the end of the stride, (stage D), where the forward portion of the sole-adhered ground-water layer tends to continue forward and thus separates and detaches at 3" from the sole. This ejects the separated forward portion of the layer 3" upwardly as shown by the arrow in stage D and causes the spraying and wetting of the footwear upper 2' as it is lowered, as more clearly shown in FIGS. 2 and 3. The earlier stage C' is shown in FIG. 1B for running, as distinguished from walking.

Figures 6, 6A:
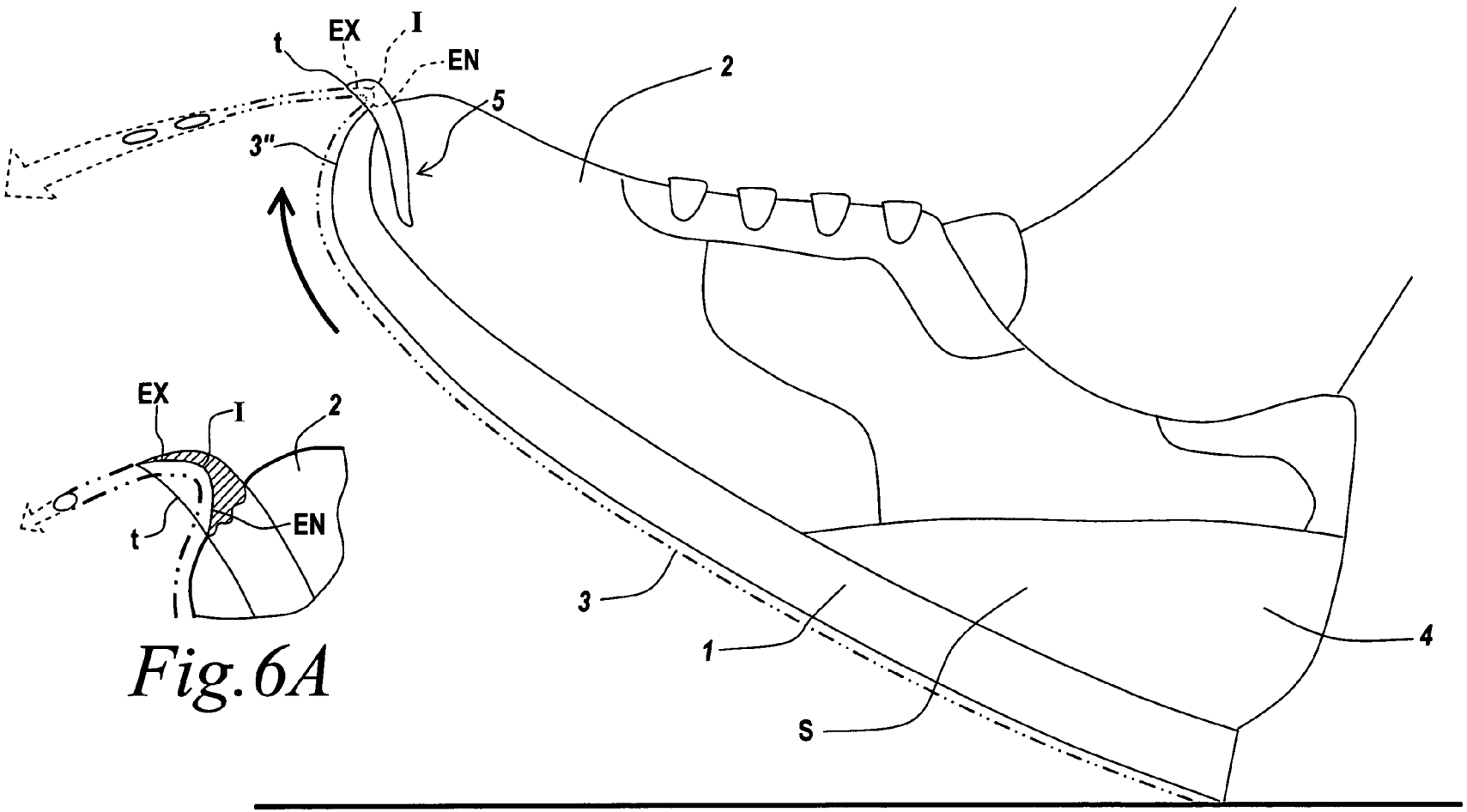
FIG. 6 is a side elevational view of the forward spray deflection of FIG. 5.
FIG. 6Ais an enlarged fragmentary view of the election process.

Having found the cause of the problems, the invention then turned to providing economical, practical and universally applicable solutions. One such, for the forward upper wetting (D in FIG. 1A and in FIGS. 2 and 3), is shown in FIGS. 5, 6, and 6A wherein a downwardly open partially cylindrical re-entrant cavity strip structure 5 is attached completely transversely arcuately across the toe region T of the sole and to the adjacent regions of the toe region upper on each side. The cavity structure is bounded by an entrance wall EN adjacent and attached to the sole at the toe region, and an inner substantially partially cylindrical cavity wall I and a steep exit wall EX having a sharp trailing edge t. To smoothly and non-turbulently flow the entering separated front water layer portion 3", the entrance wall is preferably gradually inclined into the cavity interior deflection strip structure. With this re-entrant cavity the forward layer 3" that has separated from sole 1 is flowed forwardly along the sole and into the transverse cavity entrance EN and there into the interior I of the substantially cylindrical open cavity extending transversely across the sole near its toe region. By appropriate dimensioning of the volume of the cylindrical cavity, the detached water layer 3" flowing forwardly into the structure 5 is smoothly and arcuately reversed in direction as shown by the dotted lines of FIGS. 5, 6 and 6A, and is then ejected out of the cavity and downwardly from the footwear toe region, preventing spray-wetting of the toe and forward portion of the upper 2.

Figure 7:
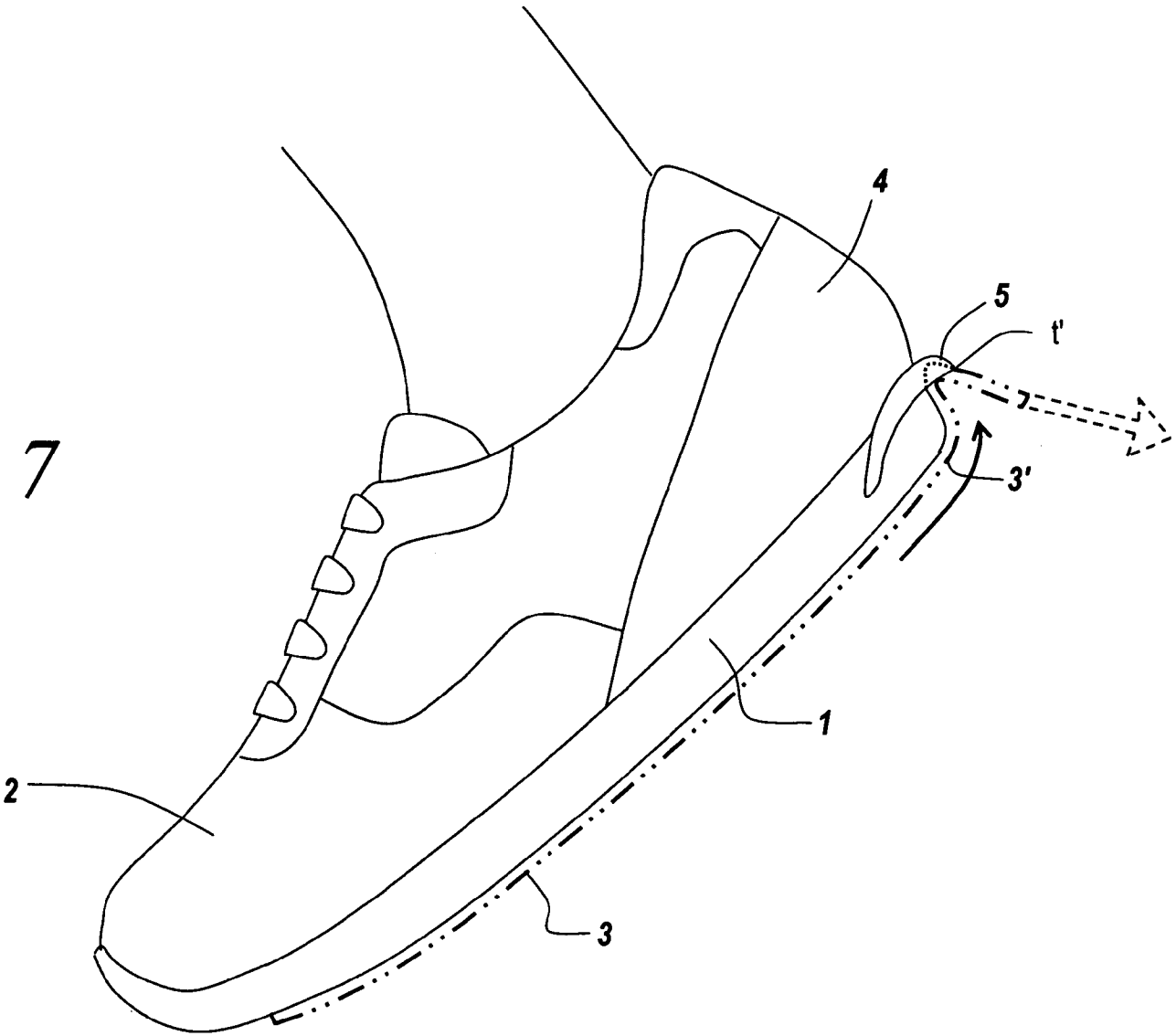
FIG. 7 is a side elevation of such a novel deflector provided at the heel region of the sole to deflect the otherwise rearward and upward heel-wetting spray of stage C in FIG. 1 and in FIG. 4, rearwardly and downwardly away from the heel region.

Similar deflection away from the heel region 4 is shown effected in the embodiment of FIG. 7 where a similar downwardly open partially substantially cylindrical re-entrant cavity strip structure 5' is attached transversely across the sole near the heel region, reversing (C in FIG. 1A and in FIG. 7) the lagging rearward separating portion 3' of the water layer by flowing the same into the entrance and deflecting it by reversing the rearward direction of flow out of the cavity exit wall at its trailing edge t', as shown by the dotted arrow of FIG. 7. As the wearer continues the stride, the spray is deflected rearwardly downwardly away from the heel region 4, preventing the wetting of the same.

In the preferred embodiment of the invention, however, instead of attaching (as adhesively or otherwise) a separate cavity deflector strip or structure (as of plastic, rubber or metal, for example) to the sole toe and/or heal regions, the downwardly open re-entrant cylindrical cavity is provided rather as a transverse linear recess or cut in the sole itself—an integral part thereof (molded or otherwise), shown in the dress shoe of FIG. 8 at 5", for a nose region deflector, and at 5''' for rearward deflection. If desired, as in the case of the separate cavity deflector strips, these cavity recesses may be formed completely transversely linearly across both the nose region of the sole and near the heel region, or either one, as desired. FIGS. 8A and 8B or transverse sections of such forward and rearward cavity recesses. These transverse linear recesses are formed of substantially the same cross-sectional shape as the re-entrant cavity attachment deflection structures 5 of FIGS. 5 and 6 and 5' of FIG. 7—having smoothly inclined flow guiding entrance walls EN', inner partially cylindrical cavity interior walls I' for reversing flow direction, and a steep exit wall EX' with sharp trailing edge t' for ejecting the flow in the reverse direction away from the footwear upper toe and hell regions, respectively, again, the re-entrant downwardly opening recess cavities are made of sufficient volume and shape so as to reverse or re-direct the direction of the entering water layer flow, and eject the water from the interior of the cavity out of the same in such reverse or re-directed direction—and away from the footwear upper.

In FIG. 9, the use of transversely spaced longitudinal ribs R as shown, lined or spaced within and across the cavity walls to provide rigidity in view of the recesses formed in the sole material, and also to protect against rapid wearing of the recess cavity steep exit wall trailing edge t' (FIG. 9C).

While highly useful in molded sports footwear as in FIGS. 5 and 7, and also in formal shoes and the like as in FIGS. 8 and 9, the invention is universally useful with other types of footwear, as well, such as the open sandals of FIG. 10.

A further modification is illustrated in FIG. 11 wherein at both the toe and the heel regions, cavity deflectors 5 and 5' are provided, together with integral sole recess cavities 5" and 5'''. Any desired permeations may, of course, be used.

Additionally, where walking in somewhat deeper ground water is encountered, creating side splash and ejection, FIGS. 12A and 12A', similar downwardly open longitudinally extending cylindrical cavity deflection strips may be provided in and along the sides of the sole as that 5'''' in FIG. 12B. FIG. 12C between the toe and heel regions thereof, and preferably together with the use of the toe and heel cavity deflector attachments 5 and 5' to provide substantially continuous cavity perimeter about the sole as shown in FIG. 12C.

Providing sole material M2, FIGS. 8C and 8D, adjacent the cavity recess of different (sometimes decreasing) wetting properties than the recess material M1 many be useful to relax requirements on the recess trailing edge and aid in separation.

What is claimed is:

1. A method of obviating the wetting effects on footwear uppers by spray from ground-plane water layers that attach to the footwear sole during the walking stride of a wearer, and are first accelerated therewith and then detached therefrom as the wearer reduces forward velocity near the end of the stride, thereby separating and ejecting the water layer upwardly of the sole and generating said spray, the method comprising, flowing the detached water layer forwardly along the sole and into and along a relatively gradual upwardly sloping wall entrance to a partially substantially relatively steep exit cylindrical wall of a downwardly open cavity provided in the sole and extending transversely across the sole near the toe region thereof;

dimensioning the volume of the cylindrical cavity, smoothly and accurately to reverse the forward flow of the water entering the said upwardly sloping entrance wall by changing the direction of the forward flow along the steep gradual exit wall of the cylindrical cavity; and providing a sharp transversely extending trailing edge to the exit wall that ejects the reversely flowing water layer rearwardly out of the cavity as the wearer approaches near said end of the stride, whereby the spray wetting of the upper is prevented.

2. The method of claim 1 wherein the downwardly open cavity is transversely substantially linearly extended substantially completely across the sole near said toe region.

3. The method of claim 1 wherein the toe region of the sole is curved upward along its front edge to merge into said upper.

4. The method of claim 3 wherein the downwardly open cavity is transversely extended across the sole near said merge.

5. The method of claim 2 wherein the downwardly open cavity is positioned rearward of the front of the sole on a flat forward portion of the sole.

6. The method of claim 5 wherein the cavity contains transversely spaced internal longitudinal ribs lined along the inner wall to protect the trailing edge from being blunted during said walking and to provide rigidity.

7. The method of claim 6 wherein said longitudinal ribs diverge.

8. The method of claim 5 wherein the region of the sole beyond said trailing edge is formed of material of different wetting properties than the adjacent region of the sole containing the cavity.

9. A method of obviating the wetting effects on footwear upper heel regions by spray from ground-plane water layers that attach to the footwear sole during the walking stride of a wearer and wherein a rearward portion of the attached layer lags the forward acceleration of the sole during the stride, resulting in said rearward layer portion rearwardly separating from the forwardly moving sole and thereby generating rearward and upward spray, the method comprising, flowing said ground-plane water layer portion as it lags rearwardly along and relative to the sole and along a relatively gradually downwardly sloping wall into the entrance of a partially substantially relatively steep cylindrical wall of the open cavity, provided and extending transversely substantially completely across the sole in a region near the heel region;

dimensioning the volume of the cavity, smoothly and accurately to reverse the rearward flow of the water layer entering said upwardly sloping entrance wall by changing the direction of flow along the steep upward exit wall of the cavity; and providing a steep cavity exit wall having a sharp transversely extending trailing edge that ejects the reversely flowing water layer out of the cavity as the wearer continues the stride, whereby said spray wetting of the upper heel region is prevented.

10. The method of claim 9 wherein said region is positioned forward of the rear end of the footwear heel.

11. The method of claim 9 wherein said region is positioned at the rear of the heel.

12. The method of claim 10 wherein transversely spaced longitudinal ribs are provided within and transversely along the cavity.

13. The method of claim 10 wherein the region of the sole rearward of said trailing edge is formed of material of different wetting properties than the adjacent region of the sole containing the cavity.

14. The method of obviating wetting effects on footwear upper parts, including at both the toe and heel regions, by spray from ground-plane water layers that attach to the footwear sole during the walking stride of a wearer, and wherein, in connection with the toe region of the footwear, the forward portion of such layers are first accelerated with the footwear sole and then are detached therefrom as the wearer reduces forward velocity near the end of the stride, separating such forward layer portion and ejecting the same forwardly from the sole and thereby generating spray forward and upward of the footwear; and, wherein, in connection with the heel region of the footwear, the rearward portion of such layers lag the forward acceleration of the sole during walking, resulting in rearwardly separating from the forwardly moving sole and thereby generating spray rearward and upward of the footwear;

the method comprising, providing each of the toe and heel regions of the sole with a partially substantially cylindrical downwardly open cavity extending transversely across the sole into which the respective forward and rearward separated water layer portions are flowed;

dimensioning the volume of each cylindrical cavity, smoothly and accurately to reverse the respective forward and rearward flows of water entering the respective cavities; and providing each cavity with a steep cavity exit wall having a sharp transversely extending trailing edge that ejects the respective reversely flowing water layers rearwardly and forwardly out of the respective cavities, whereby the respective spray wetting of the upper parts is prevented.

15. The method of claim 14 wherein laterally and upwardly splashed water produced as by walking into deeper groundwater that ejects from the sides of the sole is also prevented from wetting the footwear uppers by positioning laterally extending downwardly open similar cavity strips along or just above the side edges of the sole on both sides thereof, and connecting the side cavity strips with the toe and heel region cavities to form a substantially continuous cavity perimeter about the sole.

16. The method of claim 1 or 9 wherein the angle between the tangent to said trailing edge and the ground plane is adjusted to an acute angle.

17. The method of claim 16 wherein the angle is adjusted between about 40°and about 89°.

18. The method of claim 1 or 9 wherein the cavity is integral with the sole.

19. The method of claim 18 wherein the cavity is molded into the sole.

20. The method of claim 1 or 9 wherein the cavity is provided as a transverse attachment to be secured to the sole.

21. The method of claim 1 wherein the volume of the cavity occupied by the gradual upwardly sloping entrance wall is greater than that bounded by the sharply downwardly slopping cylindrical exit wall.

* * * * *